United States Patent [19]

Kagawa et al.

[11] 4,106,915

[45] Aug. 15, 1978

[54] ABRADER FOR MIRROR POLISHING OF GLASS

[75] Inventors: Fumio Kagawa; Norimichi Aoki, both of Shiojiri, Japan

[73] Assignee: Showa Denko K. K., Tokyo, Japan

[21] Appl. No.: 739,950

[22] Filed: Nov. 8, 1976

[30] Foreign Application Priority Data

| | | | |
|---|---|---|---|
| Nov. 11, 1975 | [JP] | Japan | 50-134733 |
| Nov. 11, 1975 | [JP] | Japan | 50-134734 |
| Nov. 11, 1975 | [JP] | Japan | 50-134735 |

[51] Int. Cl.[2] ..... B24D 3/32

[52] U.S. Cl. ..... 51/296; 51/283 R; 51/298 R

[58] Field of Search ..... 51/283, 308, 309, 293, 51/DIG. 30, 296

[56] References Cited

U.S. PATENT DOCUMENTS

| | | | |
|---|---|---|---|
| 2,757,494 | 8/1956 | Chaudron | 51/283 |
| 3,123,953 | 3/1964 | Merkl | 51/283 |
| 3,317,293 | 5/1967 | Rueter et al. | 51/293 |
| 3,684,466 | 8/1972 | Petrone | 51/298 |
| 3,915,671 | 10/1975 | Kagawa | 51/296 |

*Primary Examiner*—Donald J. Arnold

*Attorney, Agent, or Firm*—Oblon, Fisher, Spivak, McClelland & Maier

[57] ABSTRACT

An abrader for use in mirror polishing of glass comprises a porous cured unsaturated polyester resin and zirconium oxide or cerium oxide or red iron oxide. Desired mirror polishing of glass is effected by grinding the glass surface with this abrader under continued supply of water or a cutting oil to the interface of grinding.

3 Claims, 14 Drawing Figures

ABRADER FOR MIRROR POLISHING OF GLASS

BACKGROUND OF THE INVENTION

This invention relates to an abrader for use in the mirror polishing of glass articles such as optical glasses, to a method for shaping the grinding surface of said abrader and to a method for effecting the mirror polishing of glass by use of said abrader.

Optical glasses with mirror surfaces such as lenses for use in cameras, spectacles and microscopes, prisms and filters are today manufactured by a series of operations comprising roughing, fine lapping (smoothing) and mirror polishing operations.

The roughing operation constitutes a step wherein the glass surface is shaped with a grindstone or the glass surface is roughed up by moving a lapping board on the glass surface while keeping a granular lapping powder and a lapping liquid supplied to the interface therebetween.

The fine polishing operation is a step in which the glass surface is treated by interposing between the lapping board and the glass surface a lapping powder having a fine particle diameter of the order of #2000 to #500 Japanese Industrial Standard (average diameter 8 μm to 34 μm) which is finer than that of the lapping powder used in the roughing operation.

In a modified form, this fine polishing operation may be carried out by directly grinding the glass surface with diamond pellets formed by blending diamond powder and a binder.

The mirror polishing operation is for finishing the glass surface to perfect mirror smoothness by grinding the glass surface with the lapping board while continuously supplying a suspension of cerium oxide, zirconium oxide or red iron oxide to the interface between the lapping board and the glass article.

As the lapping board for use in the operations described above, there is used the type of lapping board which is formed by attaching a sheet of pitch, wax, woolen cloth or polyurethane resin to the surface of a disc made of cast iron.

According to the generally accepted theory, while the shaping of the glass surface in the roughing and fine polishing operations is mainly accomplished by causing fine glass fracture in the surface region, the shaping of the glass surface to the perfect mirror smoothness in the mirror polishing operation is attained by the fine cutting of the glass surface owing to the interaction among the glass surface, the lapping board and the lapping powder such as cerium oxide, zirconium oxide or red ion oxide, coupled with the elimination of bulges and dents on the surface due to heat flow in the glass surface, chemical reaction, etc.

For the mirror polishing of glass surface to be effected advantageously by means of the lapping board, it is imperative that the following requirements be fulfilled:

(1) The glass surface should be pressed with a uniform magnitude of pressure by the lapping board.
(2) The lapping powder should be uniformly distributed throughout the entire interface between the glass article and the disc abrader.
(3) The particle size of the lapping powder and the concentration of lapping powder in the suspension should both be proper for the operation.

It is no easy matter, however, to fulfill all these requirements. Further, since this mirror polishing operation necessitates use of suspension, the work is messy. As the lapping board is operated by an abrading machine, the suspension is likely to cause difficulties in the maintenance of the entire abrasion system.

What is more, it frequently happens in this operation that fine particles of the lapping powder from the suspension collect on the surface of a glass article under treatment and continue to cling thereto even after termination of said mirror polishing operation. For removal of the clinging fine particles, ultrasonic washing or even manual work involving use of a sharp blade is often resorted to.

The suspension is used repeatedly in this operation. As the number of repetitions increases, the lapping powder in the suspension undergoes gradual size reduction through friction and consequently the abrading capacity thereof dwindles by degrees. Eventually, it becomes necessary to start using a fresh lapping powder, in which case the new lapping powder tends to inflict scratches on the glass surface. In fact, rejects occur mostly because of such defects.

The inventors experimentally manufactured an abrader by blending a lapping powder with a polyvinyl acetal resin and molding the resultant blend and a lapping plate incorporating diamond dust and tried them in actual operations. However, both proved to be deficient in abrading capacity, durability, polishing accuracy, etc. and therefore unacceptable for practical use.

U.S. Pat. No. 3,915,671 which involves as one of the inventors thereof the inventor of the present invention covers a method for the manufacture of a porous, resin-bonded grinding tool. The grinding tool manufactured by this method comprises a cured unsaturated polyester resin and an abrasive material. Examples of the abrasive material usable in the manufacture of said grinding tool include fused alumina, silicon carbide, diamond dust, emery, garnet and glass powder.

With the grinding tool which contains such abrasive material, mirror polishing of the grade proper to optical glasses cannot be accomplished.

The present invention also embraces a method for shaping the grinding surface of an abrader.

This method is intended for uniformizing the pressure with which the glass surface being abraded and the lapping board are kept in contact with each other and also for ensuring uniform distribution of the suspension which is supplied continuously to the interface during the polishing operation, whereby the accuracy of polishing will be heightened.

Where a pitch plate is used as the lapping board, for example, the shaping of the grinding surface is effected by employing a method which takes advantage of the thermoplasticity of pitch and which comprises pressing the pitch plate against the surface of the standard plate in water heated to 40° to 70° C and allowing the plate in that state to cool off gradually. In the case of a lapping board in which a sheet of polyurethane is attached to the disc surface, the shaping of the grinding surface is effected by a method which comprises fastening this sheet by the medium of an adhesive agent to the surface of the disc while keeping the sheet pressed against the surface of the standard pate and thereafter grinding the surface of the attached sheet and the surface of the standard plate against each other. Since this sheet of polyurethane is very resistant to wear, it may be necessary on some occasions to continue said mutual grinding for a long time (on the order of several hours). The operation of surface shaping the lapping board prior to the polishing of the glass surface consumes a fairly long time no matter which method is employed. And this operation must be repeated at frequent intervals, because the grinding surface of the abrader is gradualy deformed as the polishing is continued.

Such being the case, need has long been felt for simplifying the method of surface shaping and reducing the time required for surface shaping.

The primary object of this invention is to provide an abrader for use in the mirror polishing of glass, which abrader permits the mirror polishing operation to be carried out with ease and convenience and produces a polished surface of high accuracy.

Another object of this invention is to provide a method for shaping the grinding surface of said abrader for use in the mirror polishing of glass.

Still another object of this invention is to provide a method for effecting the mirror polishing of glass by use of said abrader.

SUMMARY OF THE INVENTION

To accomplish the objects described above according to the present invention, there is provided an abrader for mirror polishing of glass, which abrader comprises a porous cured unsaturated polyester resin and a metal oxide distributed uniformly throughout said resin, said metal oxide being one member selected from the group consisting of zirconium oxide, cerium oxide and red iron oxide. In the abrader, said metal oxide selected from among zirconium oxide, cerium oxide and red iron oxide is contained in an amount corresponding to 40 to 90% by weight. While this abrader is effectively used in the form of a unitary molded piece, it may otherwise be advantageously used in the form wherein a multiplicity of molded unit pieces are mounted on a unitary circular disc.

That surface of the abrader which is brought into direct contact with the glass surface, namely the grinding surface of the abrader, is required to have a definite shape. An abrader must be given a grinding surface of a definite shape by grinding the given abrader and a disc of the standard surfacial shape against each other under continuous supply of a suspension containing fine particles of a hardness of 2 to 6 on the Old-Mohs' scale of hardness. To accomplish the mirror polishing of glass surface by use of said abrader, the polishing must be carried out while water or a cutting oil is fed continuously to the interface of grinding.

In the polishing operation performed by the method described above, the progress of polishing gradually slows down as the striations formed by fine grit on the glass surface begin to vanish. Even after total disappearance of these striations, the mirror polishing operation must be continued in the event that the glass surface has not yet been polished to the degree of mirror smoothness aimed at. In this case, discontinuation of the supply of water or cutting oil to the interface of grinding serves the purpose of speeding up the progress of polishing and consequently permitting the glass surface to be finished with an increased degree of mirror smoothness.

DESCRIPTION OF THE PREFERRED EMBODIMENTS

Figure 1:
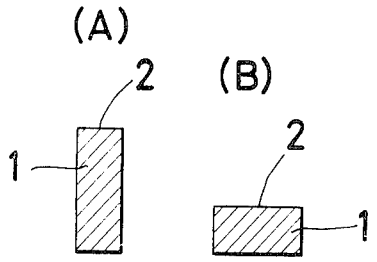
FIG. 1 represents a typical abrader of this invention, made of a unitary molded piece and used for the mirror polishing of glass surfaces.

The abrader for use in the mirror polishing of glass surface according to the present invention will be described. This abrader comprises a porous, cured unsaturated polyester resin and at least one metal oxide selected from the group consisting of zirconium oxide, cerium oxide and red iron oxide.

The method by which this abrader is manufactured is as follows:

The unsaturated polyester resin is obtained by first preparing an unsaturated polyester through the reaction of an unsaturated dibasic acid such as maleic acid or fumaric acid with a dihydric alcohol such as ethylene glycol or diethylene glycol and subsequently dissolving said unsaturated polyester in a vinyl type monomer such as styrene vinyl acetate or methyl methacrylate. The unsaturated polyester resin thus produced is generally a viscous oily liquid and is insoluble in water. Then, this unsaturated polyester resin and water are combined to produce a water-in-oil emulsion. In the preparation of this emulsion, the mixing ratio by weight of the resin to water is in the range of from 1/0.5 to 1/3, preferably from 1/1.5 to 1/2.5. Then, at least one member selected from the group consisting of zirconium oxide, cerium oxide and red iron oxide is dispersed and suspended in the emulsion. The amount of such metal oxide to be added to the emulsion is such that the ratio by weight of the metal oxide to the emulsion falls in the range of from 0.3/1 to 4/1, preferably from 0.5/1 to 2/1.

The emulsion now containing the metal oxide is subsequently added with a known curing agent such as methylethyl ketone peroxide, for example, and poured in a mold of a desired shape and left to stand therein at temperatures ranging from normal room temperature to 130° C, preferably from 60° to 120° C. As the result of this standing, the charge in the mold is cured and partially or wholly dehydrated, affording an abrader of said desired shape.

The abrader thus obtained contains pores 0.1 to 50 $\mu$ in diameter, with the porosity falling in the range of from 20 to 70% (the porosity calculated on the assumption that the abrader has been dehydrated to 100%). The amount of the metal oxide present in the abrader is in the range of from 40 to 90% by weight based on the weight of the abrader. If the content of the metal oxide exceeds the upper limit of 90%, then the abrader wears off quickly and tends to sustain scratches. If it fails to reach the lower limit of 40%, then the abrader is deficient in grinding capacity.

The abrader can effectively be used in the form of a unitary molded pieice. It may otherwise be used similarly effectively in the form wherein a plurality of molded unit pieces are spaced regularly on a circular disc.

The form in which the abrader of this invention should be used is determined by the shape and dimensions of the product to be obtained by the grinding, the kind of glass of which the glass article under treatment is made and the intended use of the product.

Preferred embodiments of the abrader of this invention for use in the mirror polishing of glass surfaces are illustrated in FIGS. 1–9.

In the drawings, 1 denotes an abrader of this invention which consists solely of one unitary molded piece.

In FIG. 1(A), the abrader is in the shape of a tall cylinder. In FIG. 1(B), it is in the shape of a short cylinder. In each of the abraders, the end 2 at which the abrader comes into contact with the article subjected to grinding has a flat surface.

Figure 2:
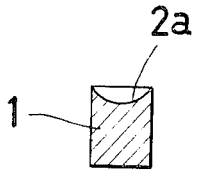
FIG. 2 illustrates an abrader of this invention, made of a unitary molded piece, having a concave edge and used for the mirror polishing of glass surfaces.
Figure 3:
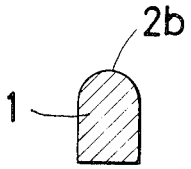
FIG. 3 illustrates an abrader of this invention, made of a unitary molded piece, having a convex edge and used for mirror polishing of glass surfaces.
Figure 4:
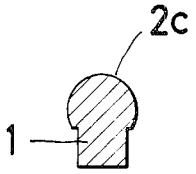
FIG. 4 illustrates an abrader of this invention, made of a unitary molded piece having a bulbous edge and used for mirror polishing of glass surfaces.

FIGS. 2, 3 and 4 show other examples of cylindrical abraders of which the ends 2*a*, 2*b* and 2*c* have concave, convex and bulbous surfaces.

The abraders of the shapes described above are porous, so that the liquid to be used in the polishing operations described afterward will be occluded in the pores thus distributed therein. During the actual polishing operations, therefore, the liquid thus occluded in the pores is constantly released to produce a cooling effect and thereby preclude seizure. Consequently, the grinding can be continued with the grinding surface of the abrader kept in constant contact with the glass surface without causing any clogging in the interface. Since the abrader of this invention has proper elasticity, it maintains contact advantageously with the glass surface. Because of its shock-absorbing property, the abrader inflicts no scratches on the glass surface. Thus, this abrader enables the glass article to be finished with mirror surface of high accuracy.

This abrader may be provided in the end face thereof with grooves incised in the form of a network. The grooves serve as a kind of reservoir for the liquid during the polishing operations, with the result that the abrader's ability to prevent seizure will be further enhanced.

So far as the size of the glass article subjected to grinding is within certain limits, the abrader made of one molded unitary piece and adapted for the glass article will suffice for the purpose.

Now, other preferred embodiments of the abrader of this invention for the mirror polishing of glass surface will be described.

Figure 5:
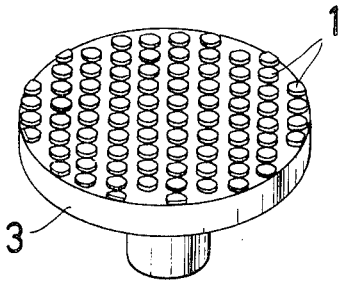
FIG. 5 represents a typical abrader of this invention for use in mirror polishing of glass surfaces, which comprises a circular disc and a plurality of molded unit pieces mounted on said circular disc.

FIG. 5 illustrates an abrader of the present invention which is formed by having a plurality of molded unit pieces 1 disposed at proper intervals from one another on the surface of a circular disc 3, with the bases of said pieces attached immovably to said surface.

Said disc may be made of a metallic substance such as cast iron or of a synthetic resin, for example. To the surface of this disc, the bases of said unit pieces are to be immovably fastened by the medium of an adhesive agent, for example.

Figure 6:
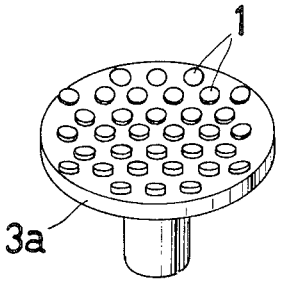
FIG. 6 illustrates an abrader of this invention for use in mirror polishing of glass surfaces, wherein the circular disc has an inwardly curved surface of a suitable radius of curvature.

FIG. 6 illustrates another abrader of the present invention which is formed by having a plurality of molded unit pieces 1 disposed at proper intervals from one another on the concave surface of a disc 3*a*, said concave surface having a proper radius of curvature and the bases of said pieces immovably fastened to said surface.

Figure 7:
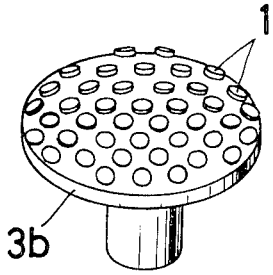
FIG. 7 illustrates an abrader of this invention for use in mirror polishing of glass surfaces, wherein the circular disc has an outwardly curved surface of a suitable radius of curvature.

FIG. 7 illustrates an abrader identical in construction with that of FIG. 6, except that the disc has a convex surface 3*b* instead of the concave surface.

Figure 8:
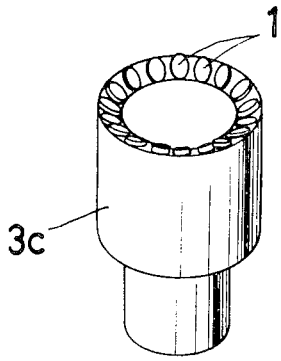
FIG. 8 illustrates an abrader of this invention for use in mirror polishing of glass surfaces, wherein the forward end of a cylinder containing at the center thereof an inwardly curved surface serves as a circular disc.

FIG. 8 illustrates still another abrader of this invention which is formed by having a plurality of molded unit pieces 1 disposed at proper intervals in the pattern of a ring along the edge portion of the centrally concave end surface of a cylinder 3*c*, with the bases of said unit pieces immovably attached to said end surface.

Figure 9:
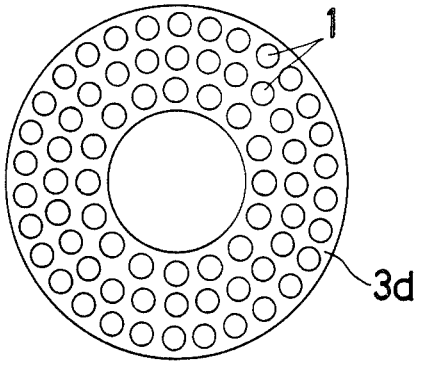
FIG. 9 illustrates an abrader of this invention for use in mirror polishing of glass surfaces, wherein the circular disc is modified to an annular shape.

FIG. 9 illustrates an abrader which is formed by having a plurality of molded unit pieces 1 disposed at proper intervals in the pattern of a plurality of rings along the annular surface of a disc 3*d*, with the bases of said unit pieces immovably attached to said surface.

The size and the shape of each abrader and the size and the number of molded unit pieces immovably attached to the surface of the disc are suitably selected with due consideration paid to the nature of the glass article subjected to grinding.

The abrader thus formed by having molded unit pieces immovably attached to the surface of the disc gives good performance in the grinding operations while minimizing the total area of contact with the glass surface.

If the grinding is carried out at a high rate of speed, fine particles generated such as by abrasion are partly driven into the pores contained in the unit pieces and partly discharged through the voids intervening between the unit pieces and, therefore, are not suffered to inflict scratches on the glass surface, enabling the desired mirror polishing to be finished easily and rapidly and with high accuracy.

Now, the method which is also embraced by this invention and which is directed to shaping the grinding surface of the abrader will be described.

To be effectively used, the abrader is required to have its grinding surface shaped so as to conform to the surface which the finished glass article is expected to possess.

The present invention accomplishes this shaping of the grinding surface of the abrader by a method which comprises grinding the surface of the abrader and the surface of the standard disc against each other while a suspension of fine particles having a hardness lower than that of glass is being continuously fed to the interface of grinding.

Since the hardness of glass generally ranges from 4 to 7 on the Old Mohs' scale of hardness, said fine particles in the suspension are desired to have a hardness approximately in the range of from 2 to 6. Examples of substances which satisfy this requirement include borax, gypsum, calcium carbonate, cryolite, zinc white, barium sulfate and aluminum hydroxide prepared in the form of fine particles. The choice from among these substances, of course, depends on the kind of glass subjected to grinding.

Use of a suspension containing fine particles of a substance having a hardness higher than that of glass must be avoided, for such fine particles tend to pierce and lodge on the surface of the molded unit pieces and may result in scratches being inflicted on the glass surface in the course of grinding.

The shaping of the grinding surface of the abrader can be accomplished in an extremely short period of time by mutually grinding the abrader and the surface of the standard disc as described above while continuously feeding to the interface of grinding the suspension of fine particles have a hardness lower than that of glass. This is because the unit pieces which make up the abrader are made of a porous substance containing fine pores measuring 0.1 to 50 $\mu$ in diameter and the shells enclosing the individual pores have a very thin wall thickness such that even the fine particles in the suspension having a hardness lower than that of glass will readily crush said shells, enabling the grinding surface of the abrader to be shaped in a short period of time.

The method of this invention by which the glass surface is given desired mirror polishing by use of the abrader of this invention will be described.

When the glass surface is subjected to mirror finishing by the conventional method, namely the method which involves use of a lapping plate and an abrasive slurry, there is a possibility that the glass surface will sustain scratches. The method of mirror polishing according to this invention is characterized by having the glass surface ground with the abrader of this invention while continuously feeding to the interface of grinding either water or a cutting oil. Since the grinding surface of the abrader perfectly fits the glass surface, the mirror polishing is capable of finishing the glass surface with mirror smoothness of high accuracy without inflicting any scratches on the glass surface.

Specifically in this mirror polishing method, as the grinding surface at the end of the abrader rubs the glass surface, the particles of zirconium oxide, cerium oxide or red iron oxide which are exposed on said grinding surface cut the surface layer of the glass and eventually effect the desired mirror polishing. Said mirror polishing proceeds quite smoothly and finishes the glass surface with highly accurate mirror smoothness because the cured unsaturated polyester resin which is the other main component of the abrader possesses a shock-absorbing property. The finished glass surface, accordingly, shows substantially no uneven polishing.

As the mirror polishing of the glass surface advances, the abrader itself undergoes abrasion and throws off fine particles. The fine particles thus generated from the abrader find their way into the pores in the abrader and, therefore, are prevented from causing clogging of the interface of grinding. As a result, the particles of zirconium oxide, cerium oxide or red iron oxide are constantly exposed on the surface, so that the mirror polishing of glass surface is allowed to proceed smoothly without any hindrance.

Even if any of the unit pieces of the abrader happens to contain coarse grains of zirconium oxide, cerium oxide or red iron oxide, such coarse grains are embedded in the resin and only limited parts of such coarse grains come into contact with the glass surface. Thus, there is no possibility that pressure will be concentratedly exerted on particular coarse grains of said metal oxide to inflict scratches on the glass surface.

In the case of the abrader of a type having a plurality of molded unit pieces disposed on the disc, the fine particles generated from the grinding surface thereof find their way into the voids intervening between said unit pieces and they are also washed out of the abrader by virtue of these voids. This abrader, accordingly, is completely free of causes which might inflict scratches on the glass surface.

If the mirror polishing by the method of this invention is carried out in the total absence of supply of water or cutting oil, then the ground surface of the glass will sustain stains from fusion caused by frictional heat. Water or the cutting oil is highly effective in cooling the interface of grinding and has a low degree of viscosity. In the presence thereof, the mirror polishing proceeds quite smoothly. Cutting oil is readily available as, of course, is water.

The method of the present invention is simple compared to the conventional methods, capable of finishing the glass surface with mirror smoothness of high accuracy and advantageous in that it contributes to improvement of the work environment, permits simplification of process control and promotes simplification of the work of cleansing the glass which has undergone mirror polishing.

Generally, the glass surface can be finished with mirror smoothness of high accuracy by the method described above. If the mirror finish obtained by this method proves to be insufficient, then the glass surface must be further subjected to mirror polishing by the method to be described below. The mirror polishing performed by the method described above proceeds rapidly so far as the glass surface being ground is coarse. As the mirror polishing is continued until the striations inflicted on the glass surface by friction substantially vanish, the glass surface resulting from the mirror polishing usually acquires the mirror smoothness aimed at. Continued mirror polishing may on some occasions be found necessary where the ground glass surface is still deficient in Newtonia accuracy (accuracy determined by examination of interference fringes) or said surface is found to retain detectable striations or other marks.

Generally in this case, the mirror polishing has already been continued until disappearance of the striations inflicted by the abrader particles. Moreover, if the mirror polishing is continued while under continued supply of water or a cutting oil to the interface of grinding, the rate at which the polishing proceeds is remarkably lowered. The reason why the polishing slows down is that the striations have ceased to exist, the glass surface being polished has come near the smoothness of mirror surface and the presence of water or cutting oil has substantially eliminated frictional resistance to the interface between the abrader and the glass surface.

At this stage, the continued mirror polishing begins to proceed at a greatly increased rate when the supply of water or cutting oil to the interface of grinding is stopped. Stopping the supply of water or cutting oil results in a gradual increase in said frictional resistance. The water or cutting oil which has been occluded in the continuous fine pores distributed in the abrader exudes to the surface so that the minimum amount of necessary lubricating liquid will be constantly present in the interface between the glass surface and the abrader. Thus, the speed of polishing is substantially increased, the polishing time required for finishing the glass surface with acceptable mirror smoothness is shortened and the exudation of the occluded water or cutting oil which lasts for a fairly long period of time serves the purpose of enhancing the Newtonian accuracy and eliminating surface scratches. These functions constitute a characteristic feature which has never been attained by any of the conventional glass polishing methods.

Figure 10:
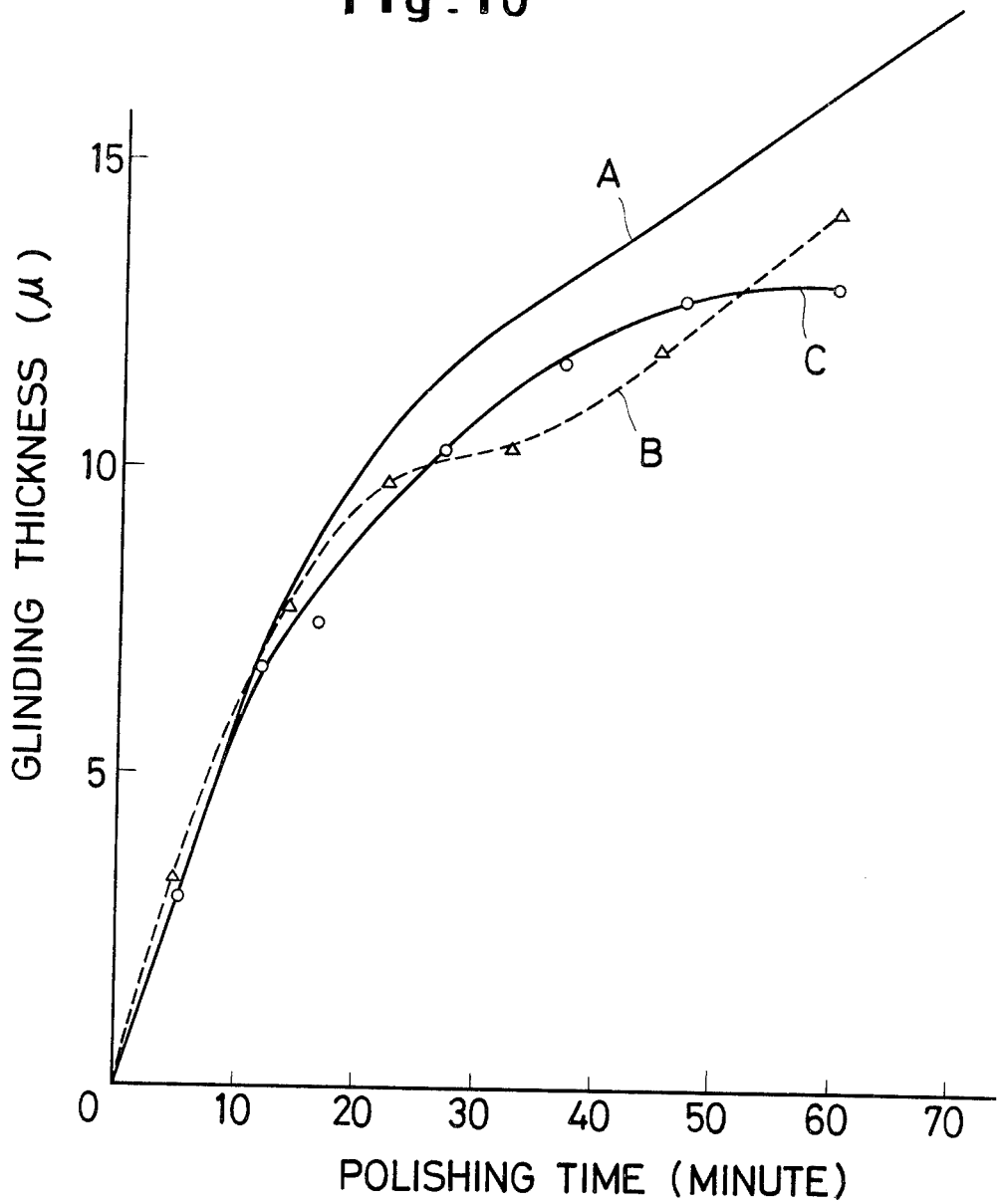
FIG. 10 is a graph showing the relation between the size of molded unit pieces and the thickness of polishing as determined of an abrader of this invention having a plurality of molded unit pieces mounted on a circular disc.
Figure 11:
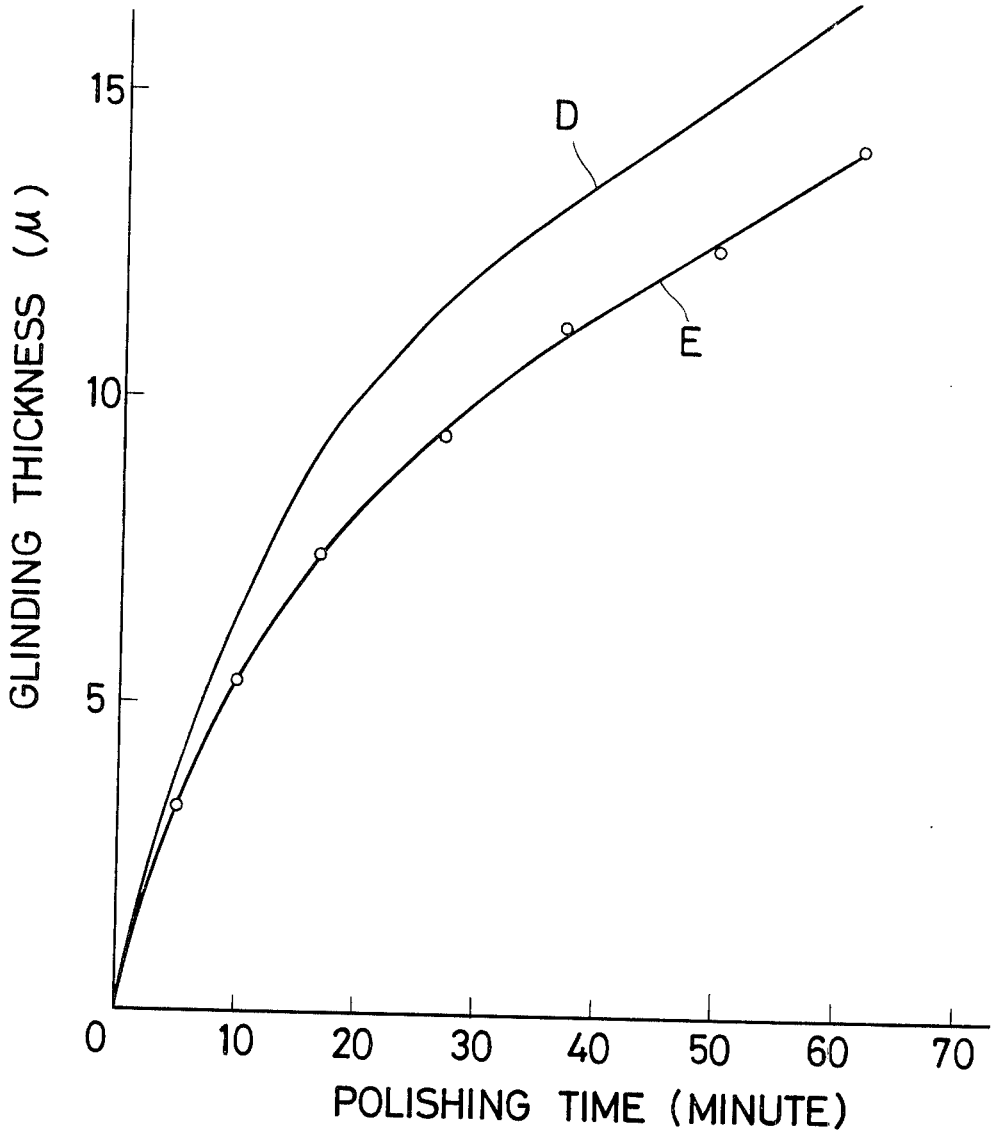
FIG. 11 is a graph showing the relation between the number of molded unit pieces and the thickness of polishing as determined of an abrader of this invention having a plurality of molded unit pieces mounted on a circular disc.

Typical data indicating the relation between the size and number of molded unit pieces and the grinding thickness as determined for abraders of this invention each having a plurality of molded unit pieces disposed on a disc are shown in FIG. 10 and FIG. 11.

Unit pieces in the shape of short cylinders were molded in varying sizes with a mixture consisting of a given amount of porous unsaturated polyester resin and an amount of cerium oxide of a volume twice as large. A number of unit pieces of each size was immovably attached to the surface of a flat disc 100 mm in diameter of cast iron at virtually the same intervals from one another to produce an abrader. The abrader had its grinding surface shaped as required. A lens 34 mm in surface diameter and 7 mm in thickness made of BK-7 (borosilicate glass called "borosilicate crown") was subjected to polishing with the abrader under the following conditions.

| | |
|---|---|
| Lens grinding machine | Oscar grinding machine (revolution number of lower axis - 100 rpm) with a 200-W motor |
| Stroke | 55 mm × 180 strokes/minute |
| Flow volume of water | 200 ml/minute |
| Pressure of grinding | 235 g/cm$^2$ (unit area of lens surface) |

The data obtained in this polishing operation are given in FIG. 10. In the graph, the vertical axis is graduated for the grinding thickness of the lens and the horizontal axis is graduated for the length of polishing time. In the graph, the curve A represents the data obtained for the abrader using unit pieces 13 mm in diameter and 4 mm in height (the combined area of the grinding surface of unit pieces was 51% of the total area of the disc), the curve B represents the data obtained for the abrader using the unit pieces 6 mm in diameter and 4 mm in height (the combined area of the grinding surface of unit pieces was 49% of the total area of the disc) and the curve C represents the data obtained for the abrader using the unit pieces 25 mm in diameter and 4 mm in height (the combined area of the grinding surface of unit pieces was 50% of the total area of the disc) respectively.

Unit pieces in the fixed shape of short cylinders 13 mm in diameter and 4 mm in height were molded with the same mixture as described above. Abraders were produced by having varying numbers of these unit pieces immovably fastened to the surface of discs. The lens of the same description was polished with each of the abraders. The data are shown in FIG. 11 in the form of the relation between the polishing thickness of the lens and the length of polishing time. In the graph, the vertical axis and the horizontal axis are graduated similarly to those of FIG. 10. The curve D represents the data obtained of the abrader using a total of 30 unit pieces and curve E those of the abrader using a total of 40 unit pieces respectively.

It is clear from these graphs that the amount of polishing varies with the diameter of the molded unit pieces and the total area of the grinding surface of unit pieces disposed on the disc. The data, therefore, suggest that the conditions of the abrader should be decided with due consideration paid to the material of the glass being polished and the intended use of the finished glass.

The present invention will be described hereinbelow with reference to working examples.

EXAMPLE 1

An abrader of this invention as illustrated in FIG. 5 was obtained by causing a total of 30 molded unit pieces 13 mm in diameter and 4 mm in height to be disposed immovably on the surface of a disc 100 mm in diameter (with the combined area of the grinding surface of unit pieces amounting to about 50% of the total area of said disc). This abrader was used to give mirror polishing to the surface of a glass made of BK-7 which had undergone a fine polishing treatment with brown alumina (A) #1200 (having an average particle diameter of 13 mm as measured by the method of JIS), with water supplied to the interface of grinding at 200 cc per minute and pressure applied to the disc at 235 g/cm$^2$.

Figure 12:
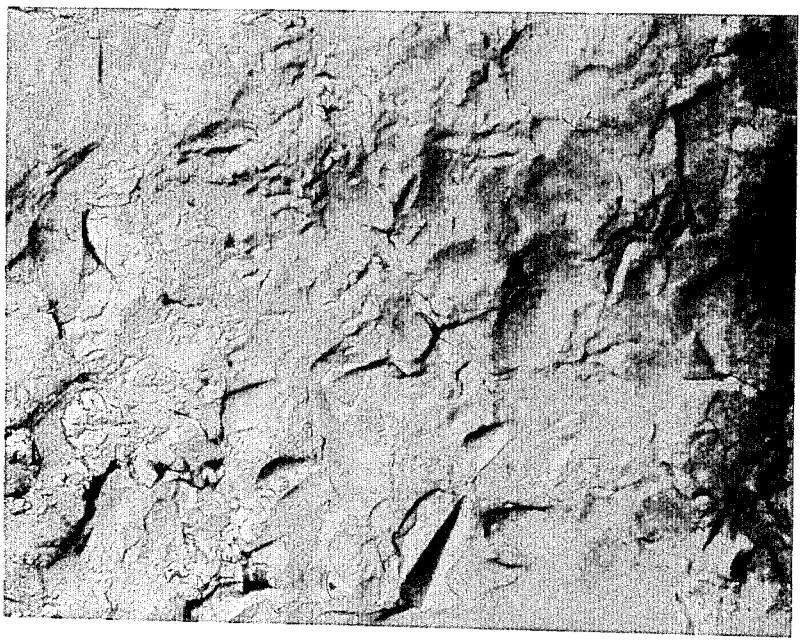
FIG. 12 is a photomicrograph of the surface of a lens taken after the fine polishing performed as indicated in Example 1.

FIG. 12 is a photograph of the surface of said lens taken after said fine polishing treatment through an electron microscope at 4,000 magnifications (by replica method).

Figure 14:
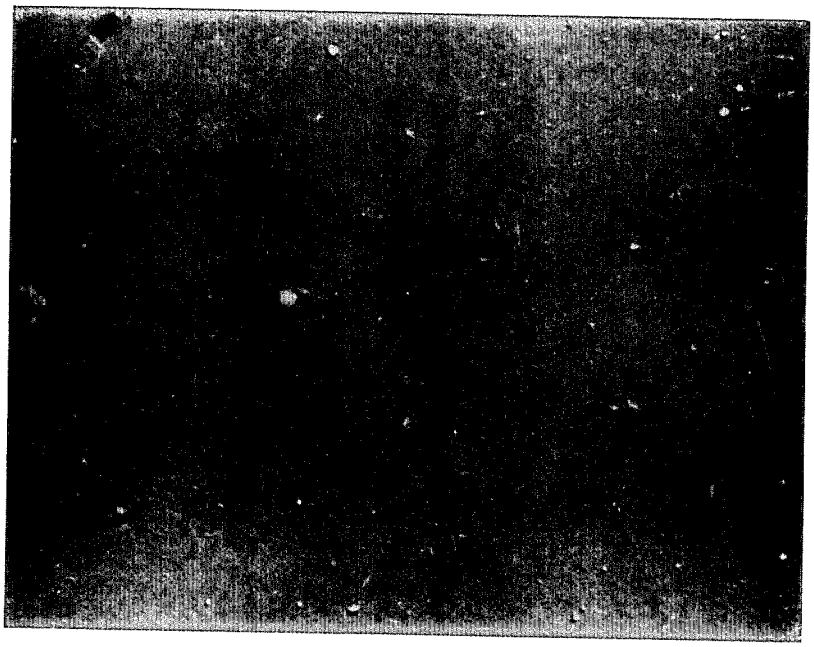
FIG. 14 is a photomicrograph of the surface of a lens taken after the grinding performed by the method of this invention as indicated in Example 1.

FIG. 14 is a photograph of the surface of the lens taken through an electron micrograph at 20,000 magnifications to show the outcome of the mirror polishing carried out by the method of this invention by use of said abrader of this invention on the surface of lens resulting from the fine polishing treatment.

COMPARATIVE EXAMPLE 1

Entirely the same lens surface as obtained by the fine polishing treatment in Example 1 was polished with a lapping board under a pressure of 115 g/cm$^2$ under continued supply to the interface of grinding at 15 cc/minute of a lapping agent in the form of a water slurry containing cerium oxide at a concentration of 15%. The results are shown in FIG. 13.

Figure 13:
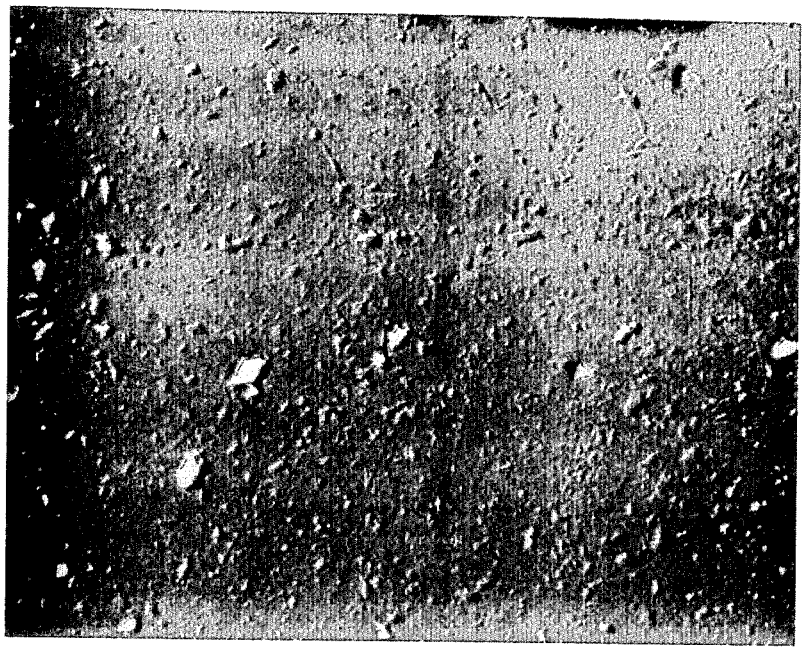
FIG. 13 is a photomicrograph of the surface of a lens taken after the grinding performed by the conventional technique as described in Example 1.

Superiority of the lens surfaces obtained by the mirror polishing treatment of the present invention to those obtained by the conventional method is evident from comparison of the data of FIGS. 12, 13 and 14.

EXAMPLE 2

A water-in-oil emulsion was obtained by agitating 100 parts (by weight; the same hereinafter) of an unsaturated polyester resin having a styrene content of 30%, 2 parts of cobalt naphthenate as the curing accelerator and 3 parts of triethanolamine as the emulsifier in a household blender wwhile under continued gradual dropwise addition thereto of a total of 150 parts of water. This emulsion was gently agitated with 200 parts of cerium oxide and the resultant mixture was further agitated with 2 parts of a curing accelerator (methylethylketone). The mixture thus obtained was cast in a cylindrical mold 13 mm in diameter and left to cure at normal room temperature for 12 hours. The molded piece was released from the mold, dried at 80° C for 12 hours to be cured and dehydrated and cut into unit pieces 4 mm in height. On the surface of a flat disc of cast iron 100 mm in diameter, 30 unit pieces of the shape of short cylinders (containing continuous pores about 5 μ in diameter) were immovably attached at one end by the medium of an epoxy adhesive agent at substantially equal intervals to produce an abrader. A quick-drying ink was applied to the surface of each unit piece.

The abrader was set in position as the lower disc in an Oscar polishing machine and rotated at 100 r.p.m. As the upper disc, a standard disc having a flat surface was set in position and caused to reciprocate while sliding on the lower disc under a load of 1 kg, with a slurry containing 30% of borax (having a hardness of 2 to 2.5) continuously poured to the interface of grinding for 30 seconds. The two surfaces were then ground against each other under an increased load of 3 kg and continued pouring of the slurry for 30 seconds. Then, the abrader was removed from the machine and washed with water. The ink applied to the surface of the pieces was found to have completely vanished, indicating that the shaping of the grinding surface of the abrader was accomplished in an extremely short period of time.

EXAMPLE 3

The procedure of Example 2 was repeated, except the molded unit pieces of the shape of short columns measured 6 mm in diameter and 4 mm in height.

To the surface of a disc 35 mm in diameter containing in said surface a concave 20 mm in radius of curvature, 25 molded unit pieces were immovably attached at substantially equal intervals to produce an abrader. A quick-drying ink was applied to the surface of each unit piece.

The abrader thus obtained was set in position as the lower disc in the Oscar polishing machine. As the upper disc, a standard disc 20 mm in diameter containing a convex 17 mm in radius of curvature was set in position. The two discs thus held in position were ground against each other under a load of 1 kg for five minutes, with a slurry containing 50% of barium sulfate continuously poured to the interface of grinding. A the end of the mutual grinding, the abrader was released from the machine and washed with water. The quick drying ink applied to the surface of the unit pieces was found to have completely vanished, indicating that the shaping of the grinding surface of abrader was accomplished advantageously in a very short period of time.

EXAMPLE 4

A mixture consisting of a given amount of porous unsaturated polyester resin and an amount twice as large in volume of a cerium oxide powder 1 μ in particle diameter was molded in the shape of a thin disc (100 mm in diameter and 4 mm in length) and was immovably fastened at one surface by the medium of an epoxy adhesive agent to the surface of a flat-surfaced disc of cast iron. After the fastening, the exposed surface of the molded disc was scraped to perfect smoothness by a precision lathe. On the flat surface of the disc, straight grooves about 1 mm in breadth were incised at fixed intervals of 5 mm in the pattern of a checkerboard. The abrader thus produced was operated to give mirror polishing to the lens surface under the following conditions.

| | |
|---|---|
| Lens polishing machine | Oscar's machine (lower shaft revolution number 100 r.p.m.), provided with a 200-W motor |
| Lens | One flat-surfaced lens 34 mm in diameter and 7 mm in thickness, made of BK-7 (borosilicate crown), which had undergone a fine polishing treatment using a brown electro-fused alumina abrader having an average particle diameter of 13 μm (JIS #1200). |
| Stroke | 55 mm × 180 strokes/minute |
| Flow volume of water | 200 ml/minute |
| Pressure | 200 g/cm$^2$ (unit area of lens surface) |

After one hour of this mirror polishing, the lens was measured for thickness by a micrometer to find the loss of thickness due to the polishing. The loss was found to be 12 μ. When the polished surface of the lens was elaborately examined with the aid of a light-concentration lamp, absolutely no scratch was detected. When the polished surface of the lens was photographed by the replica method through an electron microscope at 20,000 magnifications, it was found to be a mirror surface of extremely high degree of smoothness. After the lens had undergone a total of 10 cycles of such mirror polishing, no infliction of scratches was detected on the surface.

COMPARATIVE EXAMPLE 2

The polishing described in Example 4 above was repeated under the same conditions, except a slurry containing 15% of cerium oxide was fed at a flow volume of 15 ml/minute. After one hour of this polishing, the amount of lapping on the lens was found to be 15 μ. Scratches were found on two of a total of ten lenses used.

EXAMPLE 5

With the mixture of the composition of Example 4, unit pieces of the shape of discs 13 mm in diameter and 4 mm in height were molded instead of the molded unitary piece of Example 4. On the surface of a disc of cast iron 100 mm in diameter, 30 unit pieces were immovably fastened at substantially equal intervals. The abrader thus obtained was ground to have its grinding surface shaped as required. With this abrader, the same lens (SK-7 heavy crown) was subjected to mirror polishing under the same conditions as those of Example 4, except the pressure applied was 250 g/cm$^2$ and a commercially available water-soluble cutting oil diluted with water to 20 times the original volume was poured continuously to the interface of grinding. After 10 minutes of this polishing, the thickness of lens lost by abrasion was 8 μ and the striations remained to a slight extent. After 20 minutes of the polishing, the thickness of lens lost totalled 10 μ and the striations remained to a very slight extent. After 30 minutes of the polishing, the thickness of lens lost increased to 12 μ, the striations were completely absent and no scratch was detected. After one hour of the polishing, the thickness of lens lost reached 13 μ and the glass surface had the appearance of a mirror surface, with no infliction of scratch detectable.

EXAMPLE 6

Unit pieces were molded in the shape of short cylinders 19 mm in diameter and 6 mm in height with a mixture consisting of a given amount of porous unsaturated polyester resin and an amount twice as large in volume of zirconium oxide. On the surface of a flat-surfaced disc of cast iron 100 mm in diameter, 13 such unit pieces were immovably fastened at substantially equal intervals. The abrader thus produced was ground to have its grinding surface shaped as required. By repeating the procedure of Example 4, the lens of the foregoing description was given mirror polishing by use of the abrader. After two hours of the polishing, the thickness of lens lost by the abrasion was 12 μ and the glass surface had the appearance of a mirror surface and was found to sustain absolutely no scratch.

COMPARATIVE EXAMPLE 3

The procedure of Example 4 was repeated to give mirror polishing to the lens of the same description, except that a sheet of polyurethane 1 mm in thickness was set in position as the lower disc, the pressure applied was 100 g/cm$^2$, and a slurry containing 15% of cerium oxide was fed at a flow volume of 15 ml/minute. In this case, the slurry was not used cyclically but a fresh supply of slurry was fed continuously throughout the entire period of polishing.

After one hour of polishing, the thickness of lens lost by the abrasion totaled 15 μ. In the test of a total of 10 repetitions, scratches were detected in 7 out of 10 lenses.

EXAMPLE 7

Unit pieces were molded in the shape of short cylinders 13 mm in diameter and 4 mm in height with a mixture consisting of a porous unsaturated polyester resin and twice as large in volume of cerium oxide. On the surface of a flat-surfaced disc of cast iron 100 mm in diameter, 30 such unit pieces were immovably fastened at substantially equal intervals. The abrader thus obtained was ground to have its grinding surface shaped as required. The abrader was then set in position in the lower shaft of a polishing machine. The lens of the following description was given mirror polishing by use of this abrader under the following conditions.

| | |
|---|---|
| Lens polishing machine | Oscar polishing machine (revolution number of lower shaft 100 r.p.m.), provided with a 200-W motor |
| Lens | One flat-surface lens 34 mm in diameter and 7 mm in thickness, made of SK-7 |
| Stroke | 55 mm × 180 strokes/minute |
| Flow volume of water | 200 ml/minute |
| Pressure | 235 g/cm$^2$ (unit area of lens surface) |

The feeding of water to the interface of grinding was carried out as indicated in the table.

The results are shown in Table 1

Table 1

| Pouring of water | Continued | | | Stopped | | | |
|---|---|---|---|---|---|---|---|
| Length of polishing time (minute) | 5 | 12 | 20 | 30 | 40 | 50 | 60 |
| Thickness of lens lost by abrasion (μ) | 4 | 7 | 10 | 10.5 | 12 | 15 | 16 |
| Striations | Observed | Observed | Slightly observed | Not observed | | | |

COMPARATIVE EXAMPLE 4

Mirror polishing was carried out under entirely the same conditions of Example 7, except that the pouring of water was made under varying methods. The results are shown in Table 2.

Table 2

| Pouring of water | Continued | | | | | | |
|---|---|---|---|---|---|---|---|
| Length of polishing time (minute) | 5 | 12 | 20 | 30 | 40 | 50 | 60 |
| Thickness of lens lost by abrasion (μ) | 4 | 7 | 10 | 10.5 | 10.5 | 11 | 11.5 |
| Striations | Observed | | Slightly observed | Not observed | | | |

The thickness of lens lost by obtained in Example 7 were larger than those obtained in Comparative Example 4, indicating that when necessary, the mirror polishing can be further continued by discontinuing the supply of water after disappearance of striations.

EXAMPLE 8

The procedure of Example 7 was faithfully repeated, except that the lens made of BK-7 was used. The results are shown in Table 3.

Table 3

| Pouring of water | Continued | | | | | Stopped | | | Continued |
|---|---|---|---|---|---|---|---|---|---|
| Length of polishing time (minute) | 5 | 12 | 20 | 30 | 40 | 50 | 60 | 70 | 80 |
| Thickness of lens lost by abrasion (μ) | 4 | 8 | 9 | 10.5 | 12 | 16 | 20 | 23 | 23.5 |
| Striations | Observed | | | Not observed | | Not observed | | | Not observed |

Comparative Example 5

The procedure of Example 8 was repeated, except the conditions of water pouring were different. The results are shown in Table 4.

Table 4

| Pouring of water | Continued | | | | | | | | |
|---|---|---|---|---|---|---|---|---|---|
| Length of polishing time (minute) | 5 | 12 | 20 | 30 | 40 | 50 | 60 | 70 | 80 |
| Thickness of lens lost by abrasion (μ) | 4 | 8 | 9 | 10.5 | 12 | 13 | 14 | 15 | 16 |
| Striations | Observed | | | | Not observed | | | | |

What is claimed is:

1. An abrader for polishing the surface of a glass mirror, which comprises: from 40 to 90% by weight of a particulate abradant selected from the group consisting of zirconium oxide, cerium oxide and red iron oxide dispersed throughout a cured unsaturated polyester resin containing pores of a size ranging from 0.1 to 50 μm in diameter, said polyester resin having a porosity of 20 to 70%.

2. The abrader of claim 1, wherein the abrader contains a network of grooves in the surface thereof against which the glass surface is polished.

3. An abrader for polishing the surface of a glass mirror, which comprises: (1) a circular disc and (2) a plurality of unit pieces which polish said glass surface which are molded from a porous cured unsaturated polyester resin throughout which is dispersed 40–90 weight percent of at least one abradant selected from the group consisting of zirconium oxide, cerium oxide and red iron oxide, said polyester resin containing pores ranging from 0.1 to 50 μm in diameter and having a porosity within the range of 20 to 70%, and said unit pieces disposed at intervals on the surface of said disc.

* * * * *